US007594770B2

(12) United States Patent
Maruyama et al.

(10) Patent No.: US 7,594,770 B2
(45) Date of Patent: Sep. 29, 2009

(54) INK RIBBON CASSETTE

(75) Inventors: Takahito Maruyama, Fukushima-ken (JP); Yoshibumi Abe, Fukushima-ken (JP); Zenko Motoki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 213 days.

(21) Appl. No.: 11/487,616

(22) Filed: Jul. 17, 2006

(65) Prior Publication Data

US 2007/0020011 A1 Jan. 25, 2007

(30) Foreign Application Priority Data

Jul. 19, 2005 (JP) ..... 2005-208726

(51) Int. Cl.
*B41J 35/28* (2006.01)
*B41J 17/32* (2006.01)
*B41J 32/00* (2006.01)

(52) U.S. Cl. ..... 400/208; 400/207; 400/208.1; 347/214

(58) Field of Classification Search ..... 400/207–208.1, 400/209–210, 191, 194, 196.1; 347/214
See application file for complete search history.

(56) References Cited

U.S. PATENT DOCUMENTS 4,914,452 A * 4/1990 Fukawa ..... 347/214
6,155,728 A * 12/2000 Sakaino et al. ..... 400/26

FOREIGN PATENT DOCUMENTS

| | | |
|---|---|---|
| EP | 1 120 268 | 8/2001 |
| EP | 1 449 672 | 8/2004 |
| JP | 01 116663 | 8/1989 |
| JP | 2002-120446 | 4/2002 |
| JP | 2002-144616 | 5/2002 |

OTHER PUBLICATIONS

Search Report dated Nov. 8, 2006 for corresponding European Patent Application No. 06014841.8.

* cited by examiner

*Primary Examiner*—Judy Nguyen
*Assistant Examiner*—Marissa L Ferguson-Samreth
(74) *Attorney, Agent, or Firm*—Brinks Hofer Gilson & Lione

(57) ABSTRACT

An ink ribbon cassette is provided. A first and second ribbon-receiving parts of an ink ribbon cassette according to the invention includes wallsthat face each other with a predetermined distance therebetween. An ink ribbon slides on a first ribbon-sliding portion formed at a first wall of the first ribbon-receiving part and a second ribbon-sliding portion formed at a first wall of the second ribbon-receiving part, and is wound on a take-up reel from the feeding reel. A ribbon guide, which prevents the ink ribbon exposed at the second ribbon-sliding portion from coming in contact with a printer body (not shown) when the ink ribbon cassette is mounted in the printer body, is provided outside the second ribbon-sliding portion.

5 Claims, 3 Drawing Sheets

INK RIBBON CASSETTE

This application claims the benefit of the Japanese Patent Application No. 2005-208726 filed on Jul. 19, 2005, which is hereby incorporated by reference

BACKGROUND

1. Field

An ink ribbon cassette is provided.

2. Related Art

A conventional ink ribbon cassette 34 will be described with reference to a thermal transfer printer disclosed in JP-A-2002-144616. As shown in FIG. 4, the ink ribbon cassette 34 includes a first ribbon-receiving part 34*a* for receiving a feeding reel 32 on which an unused ink ribbon 31 is wound, and a second ribbon-receiving part 34*b* for receiving a take-up reel 33 on which a used ink ribbon 31 is wound.

The first and the second ribbon-receiving parts 14*a* and 14*b* are connected to each other by means of connecting walls 34*c* that face each other. In addition, an outlet 34*d*, through which the ink ribbon 31 wound on the feeding reel 32 can be withdrawn, is provided on the lower side of the first ribbon-receiving part 34*a*.

A head insertion portion 35, in which a thermal head (not shown) of a printer body is positioned and can move up and down, is provided between the connecting walls 34*c* that face each other, and between the first ribbon-receiving part 34*a* and the second ribbon-receiving part 34*b* in the ribbon cassette 34.

An escape groove 36, in which a paper feeding mechanism (not shown) can be positioned, is formed between the head insertion portion 35 and the second ribbon-receiving part 34*b* so as to have a predetermined depth.

A winding opening 34*e* is provided on the upper side of the escape groove 36 in FIG. 4, and a guide roller 34*f* formed of a metal rod is rotatably supported in the vicinity of a wall 37 (to be described below) of the winding opening 34*e*.

The ribbon cassette 34 is provided with a wall 37 between the head insertion portion 35 and the escape groove 36 and the winding opening 34*e*, through which the ink ribbon 31 drawn through the outlet 34*d* can be drawn, is provided on the lower side (upper side in FIG. 3) of the escape groove 36.

As shown in FIG. 3, in the escape groove 36, a ribbon-sliding portion 37*a* is formed at the lower end of the wall 37, and the ink ribbon 31 is drawn through the outlet 34*d* and exposed at the ribbon-sliding portion 37*a*. The ink ribbon 31 slides on the ribbon-sliding portion 37*a* of the wall 37, and is wound on the take-up reel 33.

When the ink ribbon cassette is inserted in a cassette-mounting portion formed in the printer body (not shown) in a direction perpendicular to the plane of the drawing, it is possible to mount the conventional ribbon cassette 34 in the printer body.

When the conventional ribbon cassette 34 is inserted and mounted in the cassette-mounting portion of the printer body, if the ink ribbon 31 exposed at the ribbon-sliding portion 37*a* of the wall 37 is loose, the ink ribbon is caught by the printer body. For this reason, there has been an undesirable possibility that the ink ribbon cassette 34 cannot be normally mounted.

SUMMARY

An ink ribbon cassette includes a ribbon guide capable of guiding an ink ribbon exposed at the ribbon-sliding portion formed at the end of the wall and can be normally mounted in a printer body even when the ink ribbon exposed at the ribbon-sliding portion is loose.

According to a preferred embodiment, an ink ribbon cassette includes a first ribbon-receiving part that recieves a feeding reel on which an unused ink ribbon is wound, and a second ribbon-receiving part that receives a take-up reel on which a used ink ribbon is wound. In this embodiment, the first and the second ribbon-receiving parts include walls, which face each other with a predetermined distance therebetween. The ink ribbon slides on a first ribbon-sliding portion formed at the wall of the first ribbon-receiving part and a second ribbon-sliding portion formed at the wall of the second ribbon-receiving part, and is wound on the take-up reel from the feeding reel. A ribbon guide, which prevents the ink ribbon exposed at the second ribbon-sliding portion from coming in contact with a printer body when the ink ribbon cassette is mounted in the printer body, is provided outside the second ribbon-sliding portion.

According to another preferred embodiment, in the above-mentioned structure, the ink ribbon, which slides on the second ribbon-sliding portion and is wound on the take-up reel, is guided by a guide roller provided to the printer body and is wound on the take-up reel. The second ribbon-receiving part is provided with an escape portion for the guide roller, and the ink ribbon, which is guided by the guide roller positioned at the escape portion, is wound on the take-up reel.

According to another preferred embodiment, in the above-mentioned structure, a head insertion opening in which a thermal head of the printer is inserted is formed between the walls, which face each other with the predetermined distance therebetween, so as to have a predetermined size. The second ribbon-receiving part is provided with the escape portion for the guide roller of the printer body. When the ink ribbon cassette is inserted in the printer body and the guide roller is positioned at the escape portion, the ink ribbon is guided by the guide roller.

According to another preferred embodiment, in the above-mentioned structure, the printer body is provided with a scooper that prevents the ink ribbon to be inserted from being caught by the guide roller. While the ink ribbon scooped by the scooper slides on the outer periphery of the guide roller in an axial direction, the ink ribbon cassette is mounted in the printer body.

According to another preferred embodiment, in the above-mentioned structure, the ribbon guide is provided with a slope that is inclined in a direction in which the ink ribbon is wound on the take-up reel.

According to another aspect of the invention, an ink ribbon cassette includes a first ribbon-receiving part that recieves a feeding reel on which an unused ink ribbon is wound, a second ribbon-receiving part that recieves a take-up reel on which a used ink ribbon is wound, and a guiding unit that allows the ink ribbon to pass between the first ribbon-receiving part and the second ribbon-receiving part. The guiding unit is provided between a first wall of the first ribbon-receiving part and a first wall of the second ribbon-receiving part, and is provided with a head insertion opening into which a thermal head of a printer body is inserted. The feeding reel, the take-up reel, and the guiding unit are disposed such that an acute angle is formed between a ribbon-passing direction from one end of the guiding unit toward the feeding reel and the first wall of the first ribbon-receiving part and an acute angle is formed between a ribbon-passing direction from the other end of the guiding unit toward the take-up reel and the second wall of the second ribbon-receiving part.

DRAWINGS

DESCRIPTION OF THE PREFERRED EMBODIMENTS

Figure 1:
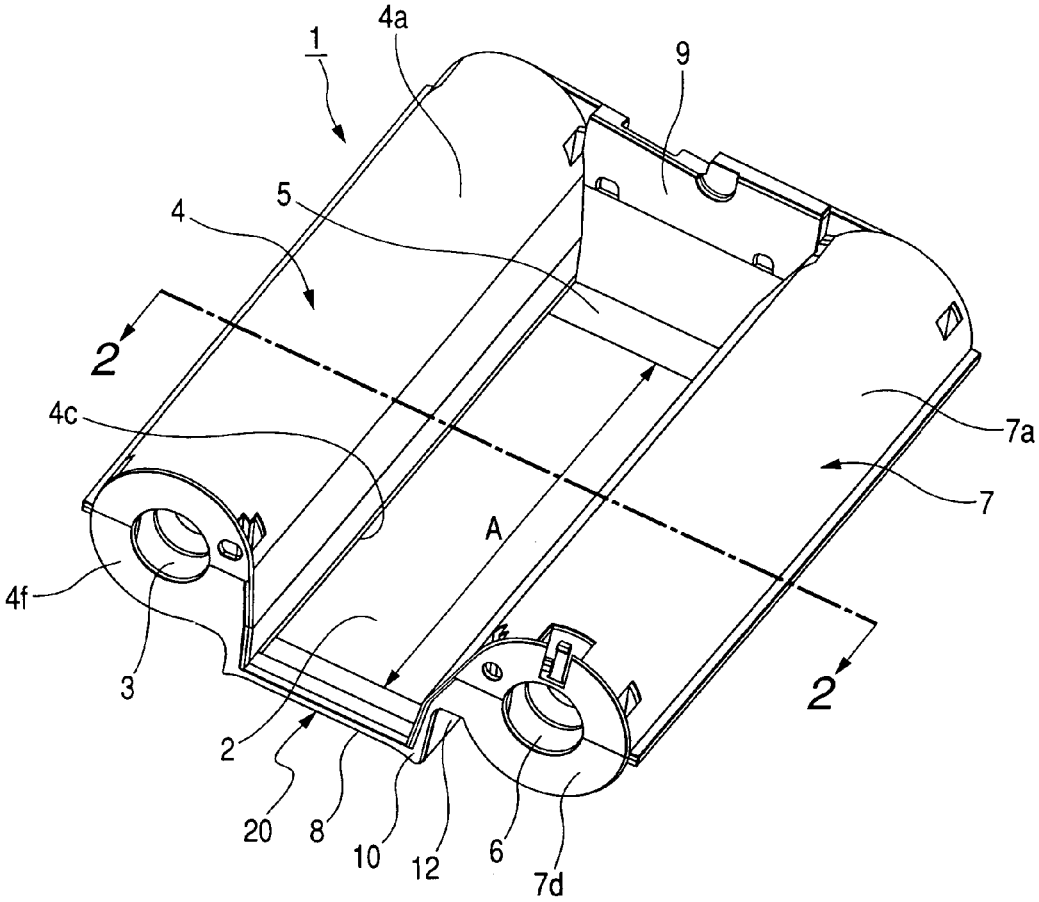
FIG. 1 is a perspective view of an ink ribbon cassette according to a preferred embodiment.

Hereinafter, an ink ribbon cassette 1 will be described with reference to the drawings. FIG. 1 is a perspective view of an ink ribbon cassette according to a preferred embodiment, FIG. 2 is a cross-sectional view taken along line 2-2 of FIG. 1, and FIG. 3 is a perspective view of a printer body in which the ink ribbon cassette 1 according to the preferred embodiment is mounted.

Figure 2:
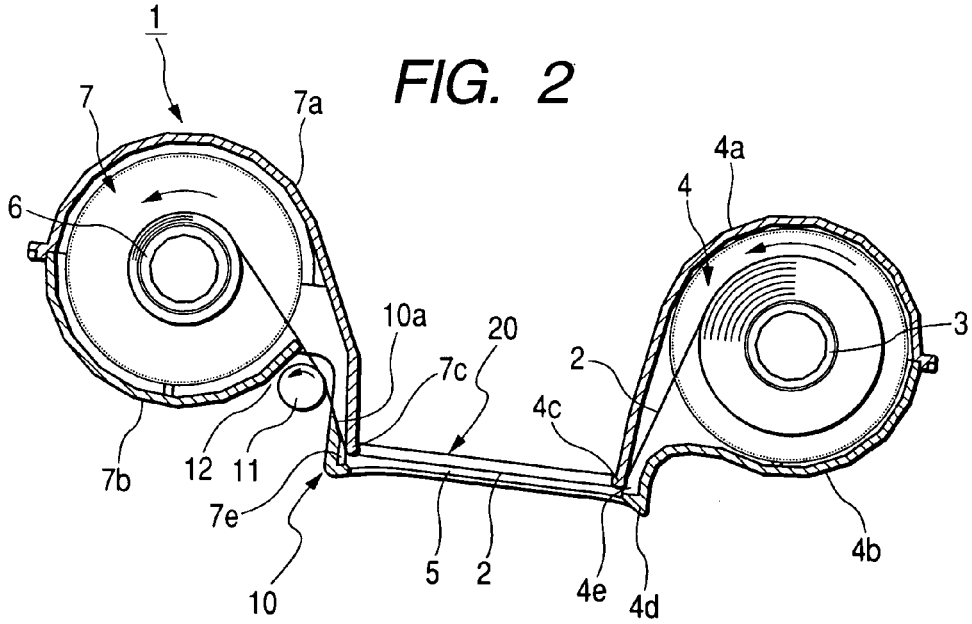
FIG. 2 is a cross-sectional view taken along line 2-2 of FIG. 1.
Figure 3:
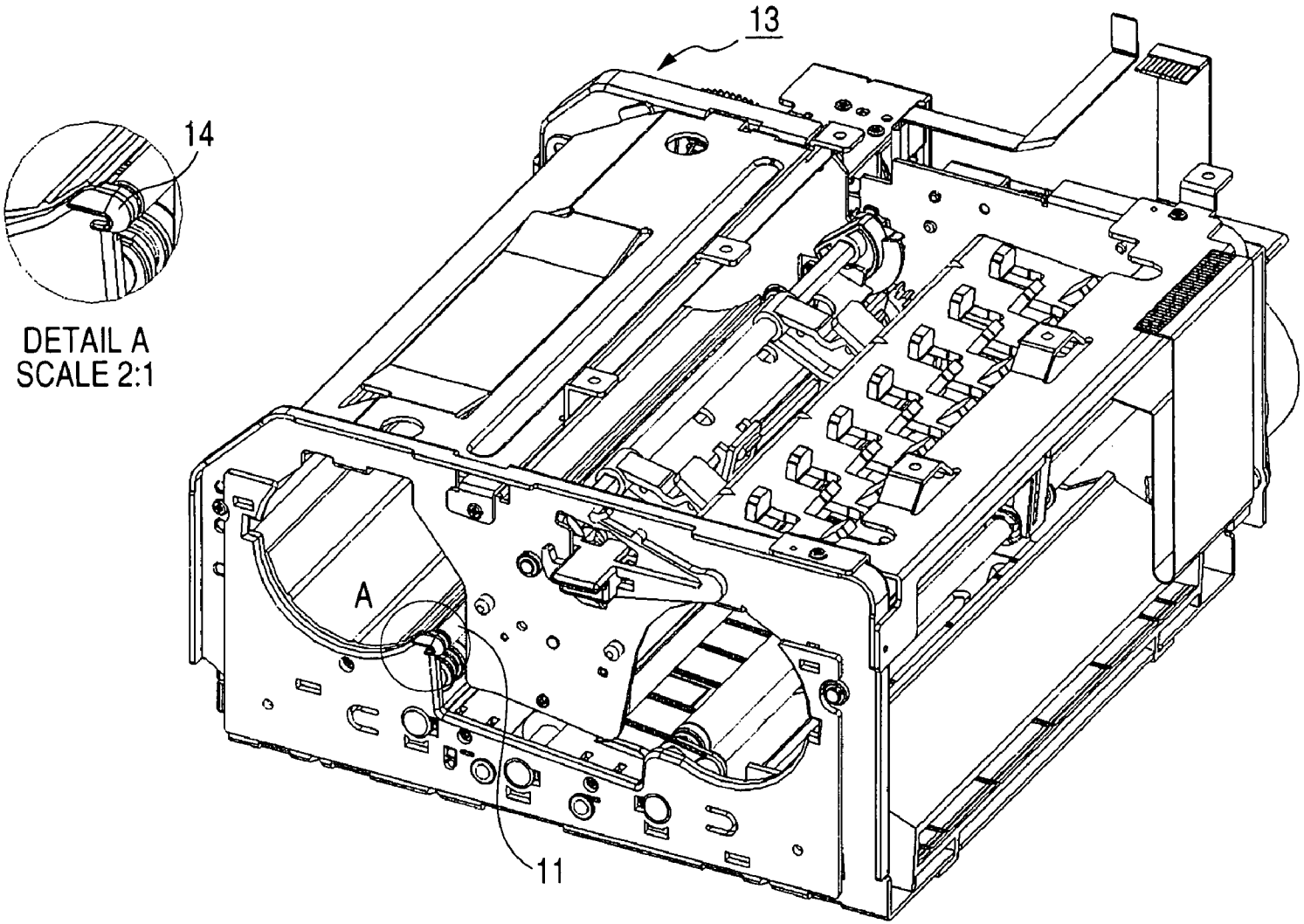
FIG. 3 is a perspective view of a printer body in which the ink ribbon cassette 1 according to a preferred embodiment is mounted.
Figure 4:
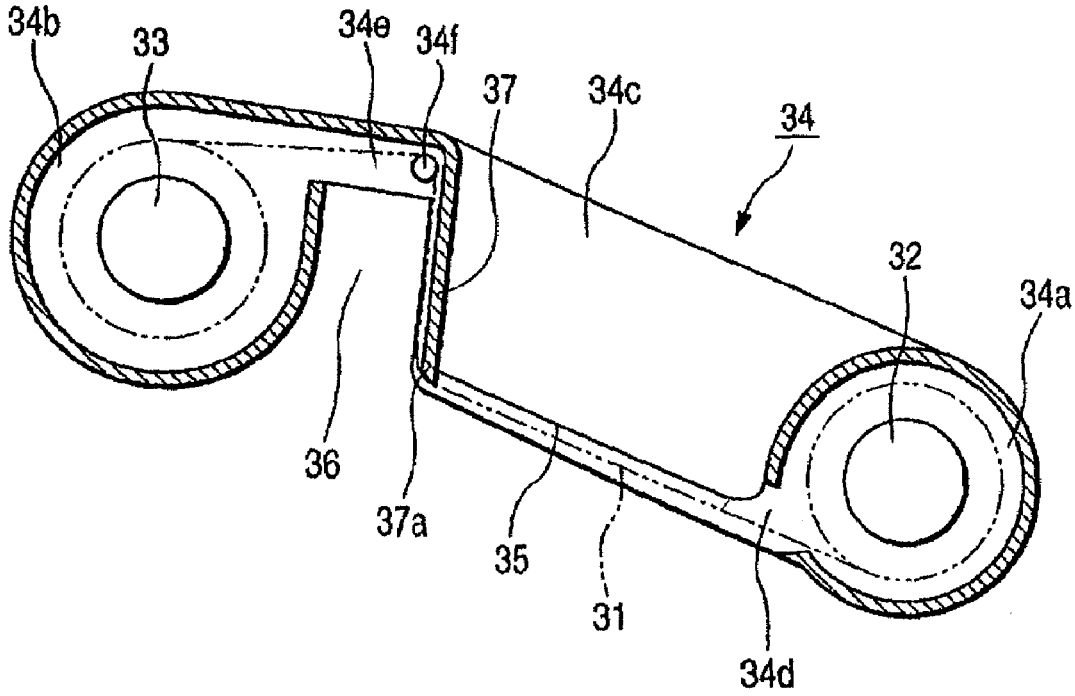
FIG. 4 PRIOR ART
FIG. 4 is a cross-sectional view of main parts of a conventional ribbon cassette.

The ink ribbon cassette 1 is made of a resin material, and is provided with a first ribbon-receiving part 4 that recieves a feeding reel 3 therein as shown in FIGS. 1 and 2. An unused ink ribbon 2 having a width of A is wound on the feeding reel 3.

The first ribbon-receiving part 4 includes a first wall 4*a* and a second wall 4*b*, which are formed in the shape of a substantially circular arc, so as to have a cavity therein. A first ribbon-sliding portion 4*c*, with which the ink ribbon 2 to be wound on a take-up reel 6 to be described below can come in sliding contact, is formed at the lower end of the first wall 4*a*.

A ribbon outlet 4*e*, through which the ink ribbon wound on the feeding reel 3 is withdrawn, is formed between the first ribbon-sliding portion 4*c* and the lower end 4*d* of the second wall 4*b*.

The front side of the hollow first ribbon-receiving part 4 shown in FIG. 1 is covered with a first sidewall 4*f*.

The ink ribbon cassette is provided with a second ribbon-receiving part 7 that recieves the take-up reel 6 therein so that the first ribbon-receiving part 4 and the second ribbon-receiving part 7 face each other with a head insertion opening 5 interposed therebetween. The second ribbon-receiving part 7 includes a first wall 7*a* and a second wall 7*b*, which are formed in the shape of a substantially circular arc, so as to have a cavity therein.

A second ribbon-sliding portion 7*c*, with which the ink ribbon 2 wound on the take-up reel 6 can come in sliding contact, is formed at the lower end of the first wall 7*a*. A guiding unit 20 of the ink ribbon 2 is provided between the first walls 4*a* and 7*a*, which face each other, of the first and the second ribbon-receiving parts 4 and 7. When printing is performed by a thermal head, the guiding unit prevents the wrinkles of the ink ribbon. The guiding unit 20 includes the first ribbon-sliding portion 4*c* and the second ribbon-sliding portion 7*c* at both ends thereof. The guiding unit is provided with a head insertion opening into which the thermal head is inserted, and also includes a ribbon guide 10 to be described below.

As shown in FIG. 2, since the ink ribbon 2 withdrawn from the feeding reel 3 comes in sliding contact with the first ribbon-sliding portion 4*c*, the ink ribbon is inclined upward with respect to the first wall 4*a* to form an acute angle. Since the ink ribbon wound on the take-up reel 6 comes in sliding contact with the second ribbon-sliding portion 7*c*, the ink ribbon is inclined upward with respect to the first wall 7*a* to form an acute angle. Since the ink ribbon 2 is inclined to form an acute angle at the both ends of the guiding unit 20, tension is always generated in the ink ribbon. For this reason, a pressed portion, which is pressed by the thermal head, of the ink ribbon 2 is flat. Accordingly, it is possible to achieve clean printing.

The front side of the hollow second ribbon-receiving part 7 shown in FIG. 1 is covered with a second sidewall 7*d*.

The first sidewall 4*f* and the second sidewall 7*d* shown in FIG. 1 are connected to each other by a crosspiece 8 on the front side of the ink ribbon cassette, and the rear sides of the first and the second ribbon-receiving parts 4 and 7 are connected to each other by a connecting member 9. The first and the second ribbon-receiving parts 4 and 7, which face each other with the head insertion opening 5 interposed therebetween, are unified.

A ribbon guide 10 is provided outside the second ribbon-sliding portion 7*c*, which is formed at the lower end of the first wall 7*a* of the second ribbon-receiving part 7, with a predetermined gap 7*e* (through which the ink ribbon to be fed can pass) between the second ribbon-sliding portion 7*c* and the ribbon guide 10.

When the ink ribbon cassette 1 is mounted in a printer body (not shown), the ribbon guide 10 can prevent the ink ribbon 2 exposed at the second ribbon-sliding portion 7*c* from coming in contact with the printer body.

The ink ribbon 2, which slides on the second ribbon-sliding portion 7*c* and is wound on the take-up reel 6, is guided by a guide roller 11 provided to the printer body 13 and can be wound on the take-up reel 6.

The second ribbon-receiving part 7 is provided with an escape portion 12 for the guide roller 11, and the ink ribbon 2, which is guided by the rotatable guide roller 11 positioned at the escape portion 12, can be wound on the take-up reel 6.

The printer body 13 in which the ink ribbon cassette 1 of the invention is inserted and mounted is provided with a scooper 14 that can prevent the ink ribbon 2 to be inserted from being caught by the end of the guide roller 11. When the ink ribbon 2 scooped by the scooper 14 of the printer body 13 (supported in a direction of separating from the end of the guide roller 11) passes by the end of the guide roller 11, the ink ribbon slides on the outer periphery of the guide roller 11 in an axial direction (a direction perpendicular to the plane of the drawing). The ink ribbon cassette 1 can be mounted in the printer body 13.

When the ink ribbon cassette 1 is mounted in the printer body 13, the guide roller 11 is positioned at the escape portion 12. The ink ribbon 2 scooped by the scooper 14 of the printer body 13 is guided by the guide roller 11 and is wound on the take-up reel 6.

The ribbon guide 10 is provided with a slope 10*a*. The slope 10*a* is inclined in a direction in which the ink ribbon 2 is wound on the take-up reel 6. For this reason, the ink ribbon 2 can be smoothly wound on the take-up reel 6 via the second ribbon-sliding portion 7*c* and the slope 10*a*.

The ribbon guide 10 is provided only outside the second ribbon-sliding portion 7*c* of the second ribbon-receiving part 7, which is shown on the left side of FIG. 2. However, a ribbon guide may be also provided outside the first ribbon-sliding portion 4*c* of the first ribbon-receiving part 4, which is shown on the right side of FIG. 2.

An ink ribbon of an ink ribbon cassette slides on a first ribbon-sliding portion formed at a wall of a first ribbon-receiving part and a second ribbon-sliding portion formed at a wall of a second ribbon-receiving part, and can be wound on a take-up reel from the feeding reel. A ribbon guide, which prevents the ink ribbon exposed at the second ribbon-sliding portion from coming in contact with a printer body when the ink ribbon cassette is mounted in the printer body, is provided outside the second ribbon-sliding portion. When the ink ribbon cassette according to the invention is inserted in the printer body, it is possible to prevent the ink ribbon at the second ribbon-sliding portion from being caught by the printer body and to normally mount the ink ribbon cassette in the printer body. For this reason, it is possible to print images with high efficiency.

The ink ribbon, which slides on the second ribbon-sliding portion and is wound on the take-up reel, is guided by a guide roller provided to the printer body and can be wound on the take-up reel. The second ribbon-receiving part is provided with an escape portion for the guide roller, and the ink ribbon, which is guided by the guide roller positioned at the escape portion, can be wound on the take-up reel. Accordingly, it is possible to reliably wind the ink ribbon of the ink ribbon cassette mounted in the printer body during printing.

A head insertion opening in which a thermal head of the printer is inserted is formed between the walls, which face each other with the predetermined distance therebetween, so as to have a predetermined size. The second ribbon-receiving part is provided with the escape portion for the guide roller of the printer body. When the ink ribbon cassette is inserted in the printer body and the guide roller is positioned at the escape portion, the ink ribbon is guided by the guide roller. Accordingly, it is possible to reliably wind the ink ribbon on the take-up reel.

The printer body is provided with a scooper that prevents the ink ribbon to be inserted from being caught by the guide roller. While the ink ribbon scooped by the scooper slides on the outer periphery of the guide roller in an axial direction, the ink ribbon cassette can be mounted in the printer body. When the ink ribbon cassette is mounted in the printer body, it is possible to reliably mount the ink ribbon cassette in the printer body without wrinkles of the ink ribbon.

The ribbon guide is provided with a slope that is inclined in a direction in which the ink ribbon is wound on the take-up reel. Accordingly, the ink ribbon can be wound on the take-up reel along the slope, whereby it is possible to smoothly wind the ink ribbon.

An acute angle is formed between a ribbon-passing direction from one end of the guiding unit toward the feeding reel and the first wall of the first ribbon-receiving part and an acute angle is formed between a ribbon-passing direction from the other end of the guiding unit toward the take-up reel and the second wall of the second ribbon-receiving part. Therefore, it is possible to always generate tension in the ink ribbon with simple structure.

The invention claimed is:

1. An ink ribbon cassette comprising:

an ink ribbon;

a first ribbon-receiving part that receives a feeding reel on which unused ink ribbon is wound; and a second ribbon-receiving part that receives a take-up reel on which used ink ribbon is wound, wherein the first and the second ribbon-receiving parts include walls that face each other with a predetermined distance therebetween, the ink ribbon slides on a first ribbon-sliding portion formed at the wall of the first ribbon-receiving part and a second ribbon-sliding portion formed at the wall of the second ribbon-receiving part from the feeding reel to be wound on the take-up reel, and a ribbon guide, which prevents the ink ribbon exposed at the second ribbon-sliding portion from coming in contact with a printer body, is provided outside the second ribbon-sliding portion, the ink ribbon sliding on the second ribbon-sliding portion to be wound on the take-up reel is guided by a guide roller provided to the printer body and is wound on the take-up reel, the second ribbon-receiving part is provided with an escape portion for the guide roller, and the ink ribbon guided by the guide roller positioned in the escape portion is wound on the take-up reel, the printer body is provided with a scooper which prevents the ink ribbon to be inserted from being caught by the guide roller, the ink ribbon scooped by the scooper slides on an outer periphery of the guide roller in an axial direction, and the ink ribbon cassette is mounted in the printer body.

2. The ink ribbon cassette according to claim 1, wherein a head insertion opening in which a thermal head of the printer body is inserted is formed between the walls, which face each other with the predetermined distance therebetween, so as to have a predetermined size, the second ribbon-receiving part is provided with the escape portion for the guide roller of the printer body, and when the ink ribbon cassette is inserted in the printer body and the guide roller is positioned at the escape portion, the ink ribbon is guided by the guide roller.

3. The ink ribbon cassette according to claim 1, wherein the ribbon guide is provided with a slope that is inclined in a direction in which the ink ribbon is wound on the take-up reel.

4. An ink ribbon cassette comprising:

a first ribbon-receiving part that receives a feeding reel on which an unused ink ribbon is wound;

a second ribbon-receiving part that receives a take-up reel on which a used ink ribbon is wound; and a guiding unit that allows the ink ribbon to pass between the first ribbon-receiving part and the second ribbon-receiving part, wherein the guiding unit is provided between a first wall of the first ribbon-receiving part and a first wall of the second ribbon-receiving part, and is provided with a head insertion opening into which a thermal head of a printer body is inserted, the feeding reel, the take-up reel, and the guiding unit are disposed such that an acute angle is formed between a ribbon-passing direction from one end of the guiding unit toward the feeding reel and the first wall of the first ribbon-receiving part and an acute angle is formed between a ribbon-passing direction from the other end of the guiding unit toward the take-up reel and the first wall of the second ribbon-receiving part, the printer body is provided with a scooper which prevents the ink ribbon to be inserted from being caught by a guide roller, the ink ribbon scooped by the scooper slides on an outer periphery of the guide roller in an axial direction, and the ink ribbon cassette is mounted in the printer body.

5. The ink ribbon cassette according to claim 4, wherein the guiding unit includes at least one ribbon-sliding portion, with which the ink ribbon comes in sliding contact, in at least one end thereof, and a ribbon guide that prevents the exposed ink ribbon from coming in contact with the printer body when the ink ribbon cassette is mounted in the printer body.

* * * * *

UNITED STATES PATENT AND TRADEMARK OFFICE

CERTIFICATE OF CORRECTION

PATENT NO. : 7,594,770 B2
APPLICATION NO. : 11/487616
DATED : September 29, 2009
INVENTOR(S) : Maruyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 287 days.

Signed and Sealed this

Twenty-eighth Day of September, 2010

David J. Kappos

David J. Kappos
*Director of the United States Patent and Trademark Office*